US005082050A

United States Patent [19]

Darragh

[11] Patent Number: 5,082,050

[45] Date of Patent: Jan. 21, 1992

[54] THERMAL RESTRAINT SYSTEM FOR A CIRCULAR HEAT EXCHANGER

[75] Inventor: Charles T. Darragh, San Diego, Calif.

[73] Assignee: Solar Turbines Incorporated, San Diego, Calif.

[21] Appl. No.: 530,955

[22] Filed: May 29, 1990

[51] Int. Cl.[5] ..... F28F 3/00

[52] U.S. Cl. ..... 165/81; 165/166; 60/39.511

[58] Field of Search ..... 165/81, 82, 165, 166; 60/39.511

[56] References Cited

U.S. PATENT DOCUMENTS

| | | | |
|---|---|---|---|
| 2,458,159 | 1/1949 | Goldthwaite | 165/81 |
| 2,978,226 | 4/1961 | White | 165/82 |
| 3,201,108 | 8/1965 | Kramer | 165/81 |
| 3,255,818 | 6/1966 | Beam, Jr., et al. | 165/166 |
| 3,285,326 | 11/1966 | Wosika | 165/4 |
| 3,476,174 | 11/1969 | Guernsey et al. | 165/9 |
| 3,507,115 | 4/1970 | Wisoka | 60/39.51 |
| 3,759,323 | 9/1973 | Dawson et al. | 165/166 |
| 3,785,435 | 1/1974 | Stein et al. | 165/166 |
| 4,098,330 | 7/1978 | Flower et al. | 165/166 |
| 4,331,352 | 5/1982 | Graves | 285/226 |
| 4,690,206 | 9/1987 | Bein | 165/81 |
| 4,697,633 | 10/1987 | Darragh et al. | 165/51 |

FOREIGN PATENT DOCUMENTS

| | | | |
|---|---|---|---|
| 843965 | 8/1960 | United Kingdom | 165/166 |

*Primary Examiner*—John Rivell
*Assistant Examiner*—L. R. Leo
*Attorney, Agent, or Firm*—Larry G. Cain

[57] ABSTRACT

Circular heat exchangers have been used to increase the efficiency of engines by absorbing heat from the exhaust gases and transferring a portion of the exhaust heat to the intake air. The present heat exchanger is built to better resist the internal forces and pressures and to better withstand the thermal stress from the cyclic operation of the engine. The plurality of evenly spaced individual tension rings are positioned about the outer portion of the core and the plurality of compressive hoops which are positioned at the inner portion of the core resisting the forces which are attempting to separate the passages. The rings and the hoops are in contact with the core and totally in heat transferring relationship with the donor fluid. The rings further expand and contract in response to the temperature changes of the donor fluid and maintain a preestablished force on the core of the heat exchanger.

41 Claims, 6 Drawing Sheets 72
202
50
16
64
206
5
200
34
32
138
36
82
5
208
24
204
22
20
29
184
182
18
20
12
27
26
36
190
32
80
34
14
16
60
28
180
22
62
44
74

Fig. 3.
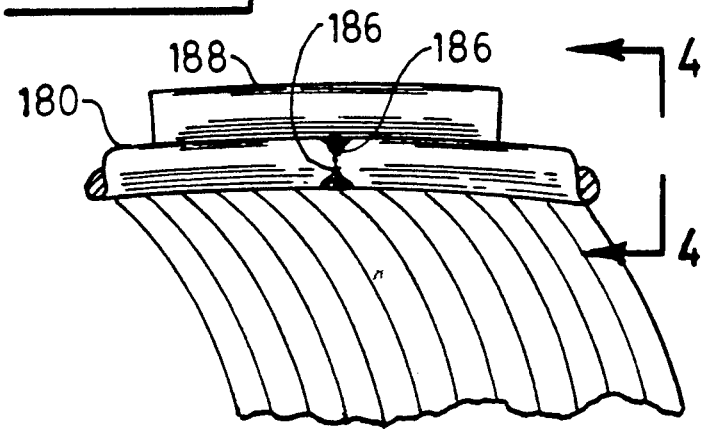
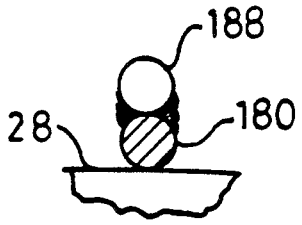
Fig. 4.

THERMAL RESTRAINT SYSTEM FOR A CIRCULAR HEAT EXCHANGER

DESCRIPTION

1. Technical Field

This invention relates generally to a heat exchanger and more particularly to the construction of a heat exchanger having a circular configuration.

2. Background Art

Many gas turbine engines use a heat exchanger or recuperator to increase the operating efficiency of the engine by extracting heat from the exhaust gas and preheating the intake air. Typically, a recuperator for a gas turbine engine must be capable of operating at temperatures of between about 500° C. and 700° C. internal pressures of between approximately 450 kPa and 1400 kPa under operating conditions involving repeated starting and stopping cycles.

Such circular recuperators include a core which is commonly constructed of a plurality of relatively thin flat sheets having an angled or corrugated spacer fixedly attached therebetween. The sheets are joined into cells and sealed at opposite sides and form passages therebetween the sheets. These cells are stacked or rolled and form alternative air cells and hot exhaust cells. Compressed discharged air from a compressor of the engine passes through the air cells while hot exhaust gases flow through alternate cells. The exhaust gas heats the sheets and the spacers and the compressor discharged air is heated by conduction from the sheets and spacers.

An example of such a recuperator is disclosed in U.S. Pat. No. 3,285,326 issued to L. R. Wosika on Nov. 15, 1966. In such a system, the recuperator includes a pair of relatively thin flat plates spaced from an axis and wound about the axis with a corrugated spacer therebetween. The air flow enters one end and exits the opposite end and the exhaust flow is counter-flow to the air flow entering and exiting at the respective opposite ends. One of the problems with such a system is its lack of efficiency and the inability to inspect or check each passage for leakage prior to final assembly.

Another example of such a recuperator is disclosed in U.S. Pat. No. 3,507,115 issued to L. R. Wosika on July 28, 1967. In such a system, the recuperator comprises a hollow cylindrical inner shell and a concentric outer shell separated by a convoluted separator sheet which is wound over and around several corrugated sheets forming a series of corrugated air cores and combustion gas cores. In order to increase the transfer between the hot gases or cold air, the corrugated sheets are metallically bonded to the separator sheets in an attempt to increase efficiency. One of the problems with such a system is its lack of efficiency and the ability to test or inspect individual passages prior to assembly into a finished heat exchanger. Furthermore, the concentric outer shell is exposed to the recuperator temperatures on one side and to the environmental temperature on the other side. Thus, as the recuperator expands and contracts due to start up and shut down, the thermal stress and strain induced in the core at the point of connection between the convoluted separator sheets, the corrugated sheets and the concentric outer shell will be greatly varied and reduce the longevity of the structure.

Another example of such a recuperator is disclosed in U.S. Pat. 3,255,818 issued to Paul E. Beam, Jr et al, on June 14, 1966. In such a system, a simple plate construction includes an inner cylindrical casing and an outer annular casing having common axis. Radially disposed plates form passages A and B which alternately flow a cooler fluid and a hotter fluid. A corrugated plate being progressively narrower in width toward the heat exchanger axis is positioned in the passage A, and a corrugated plate being progressively increasing in width toward the axis is positioned in the passage B. One of the problems with such a system is its lack of efficiency. Furthermore, the outer annular casing is exposed to the recuperator temperatures on one side and to the environmental temperature on the other side. Thus, as the recuperator expands and contracts due to start up and shut down, the thermal stress and strain induced in the core at the point of connection between the radially disposed plates and the outer casing will be greatly varied and reduce the longevity of the structure.

Another example of a circular recuperator or regenerator is disclosed in U.S. Pat. No. 3,476,174 issued to R. W. Guernsey et al, on Nov. 4, 1969. In such system, a radial flow regenerator includes a plurality of heat transfer segments formed by a number of laid-up thin corrugated sheet metal strips or shims. The segments are mounted between stiffeners, and a bridge is positioned in notches and secured to the segments. Thus, the regenerator, while providing a radial flow, fails to efficiently make use of the entire heat exchange area. For example, the stiffeners and bridges are positioned in an area which could be used for heat transferring purposes. Furthermore, the cost and complexity of the structure is greatly increased because of the notches and complex shapes of the control beams.

Another example of a heat exchanger construction is disclosed in U.S. Pat. No. 3,759,323 issued to Harry J. Dawson et al, on Sept. 18, 1973. A primary surface plate-type heat exchanger construction is shown and uses a plurality of flat successively stacked sheets having a plurality of edge bars for spacing the sheets apart. A large number of sheets are stacked in pairs with the edge bars therebetween to form a heat exchange core of a desired size.

Another example of a heat exchanger has a thermally balanced restraint system and is disclosed in U.S. Pat. No. 4,697,633 issued to Charles T. Darragh et al, on Oct. 6, 1987. A primary surface heat exchanger is made up of a plurality of individual cells held together by a plurality of tie rods extending through the hot fluid flow path and has opposite ends connected to an end beam tying the core together.

The present invention is directed to overcome one or more of the problems as set forth above.

DISCLOSURE OF THE INVENTION

In one aspect of the invention, a heat exchanger includes a core having a plurality of heat recipient passages and heat donor passages therein. The core includes a plurality of cells each defining one of the passages therein. The cells are secured together forming a generally circular core and adjacent cells form the other of the passages. The core further includes an outer portion and an inner portion. Each of the heat donor passages has a donor fluid therein during operation, and each of the heat recipient passages has a recipient fluid therein during operation. The donor fluid exerts a first working pressure and force and the recipient fluid exerts a second working pressure and force in the passages when in operation. The working pressures and forces attempt to separate the passages. The heat exchanger further includes a means for resisting the forces attempting to separate the passages and at least a portion of the means being positioned around the outer portion of the core and the entire means being totally in heat transferring relationship with the donor fluid.

In another aspect of the invention, a gas turbine engine includes an exhaust system having a donor fluid therein, an air intake system having a recipient fluid therein, a heat exchanger including a core having a plurality of heat recipient passages and heat donor passages therein and a housing at least partially surrounding the core. The exhaust system is connected to the heat donor passage, and the air intake system is connected to the heat recovery passage. The core includes a plurality of stacked cells each defining one of the passages therein. The cells are secured together, forming a generally circular core and being centered about an axis. Adjacent cells form the other of the passages therebetween and the core further including an outer portion and an inner portion. The donor fluid in each of the heat donor passages during the operation of the engine exerts a first working pressure and force within the passage resulting in a force attempting to separate the passage. The recipient fluid in each of the heat recipient passages during operation of the engine exerts a second working pressure and force within the passage resulting in a force attempting to separate the passage. Further included is a means for resisting the forces attempting to separate the passages and at least a portion of the means being positioned around the outer portion of the core and the entire means being totally in heat transferring relationship with the transfer fluid.

In another disclosure of the invention, a heat exchanger comprises a core being made of many pieces and having a first passage and a second passage adapted to receive fluids of different temperatures. The fluids exert different pressures on the heat exchanger pieces. The heat exchanger further includes a means for expanding and contracting in response to the temperature of only one of the fluids and maintains a preestablished force on the heat exchanger pieces.

BRIEF DESCRIPTION OF THE DRAWINGS

FIG. 3 is a partial section taken through a central axis and showing an end joint of a ring and a reinforcing rod attached thereto;

FIG. 4 is a section view taken along line 4—4 of FIG. 3;

BEST MODE FOR CARRYING OUT THE INVENTION

Figure 1:
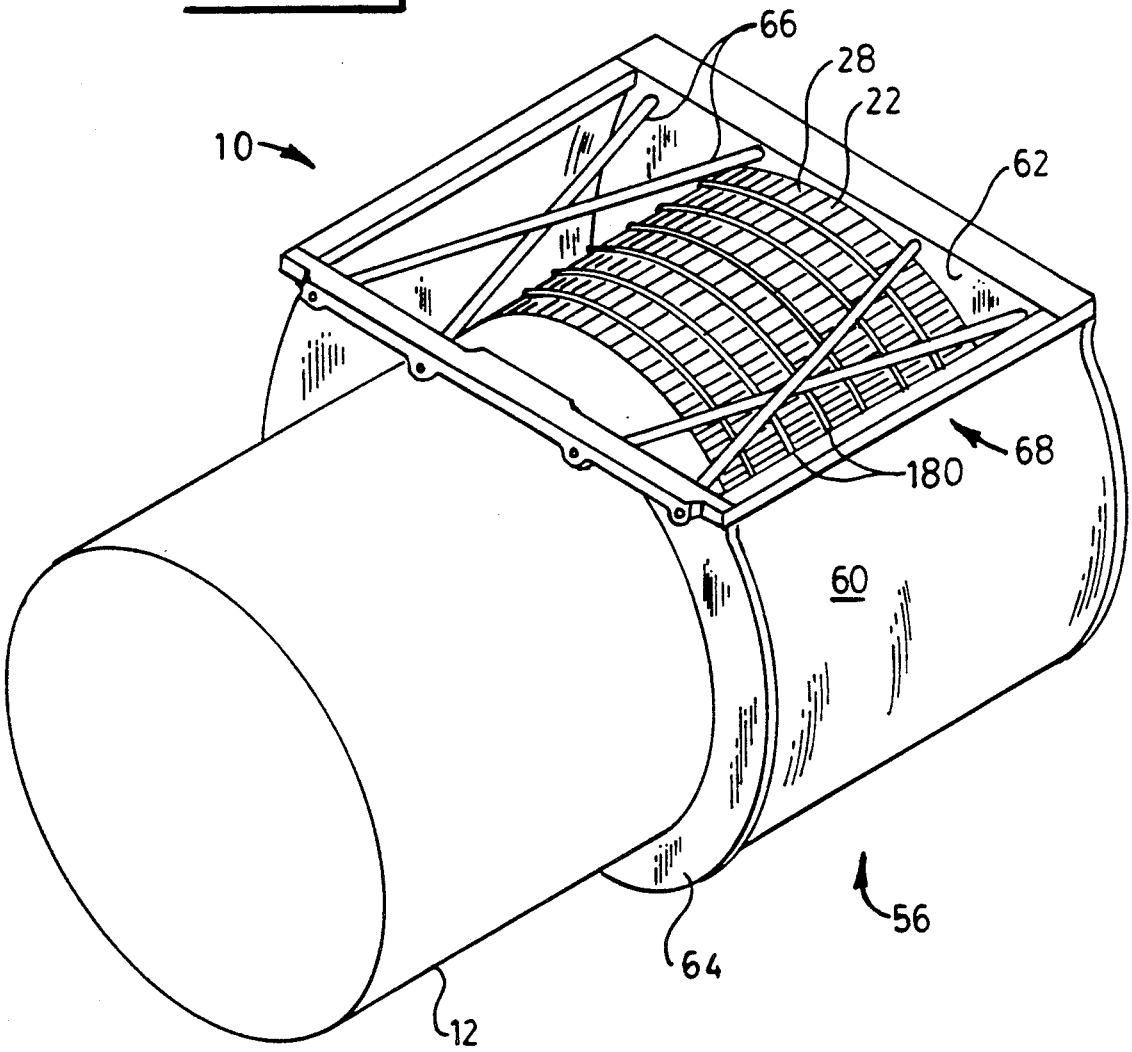
FIG. 1 is a perspective view of a portion of an engine adapter for use with an embodiment of the present invention.
Figure 2:
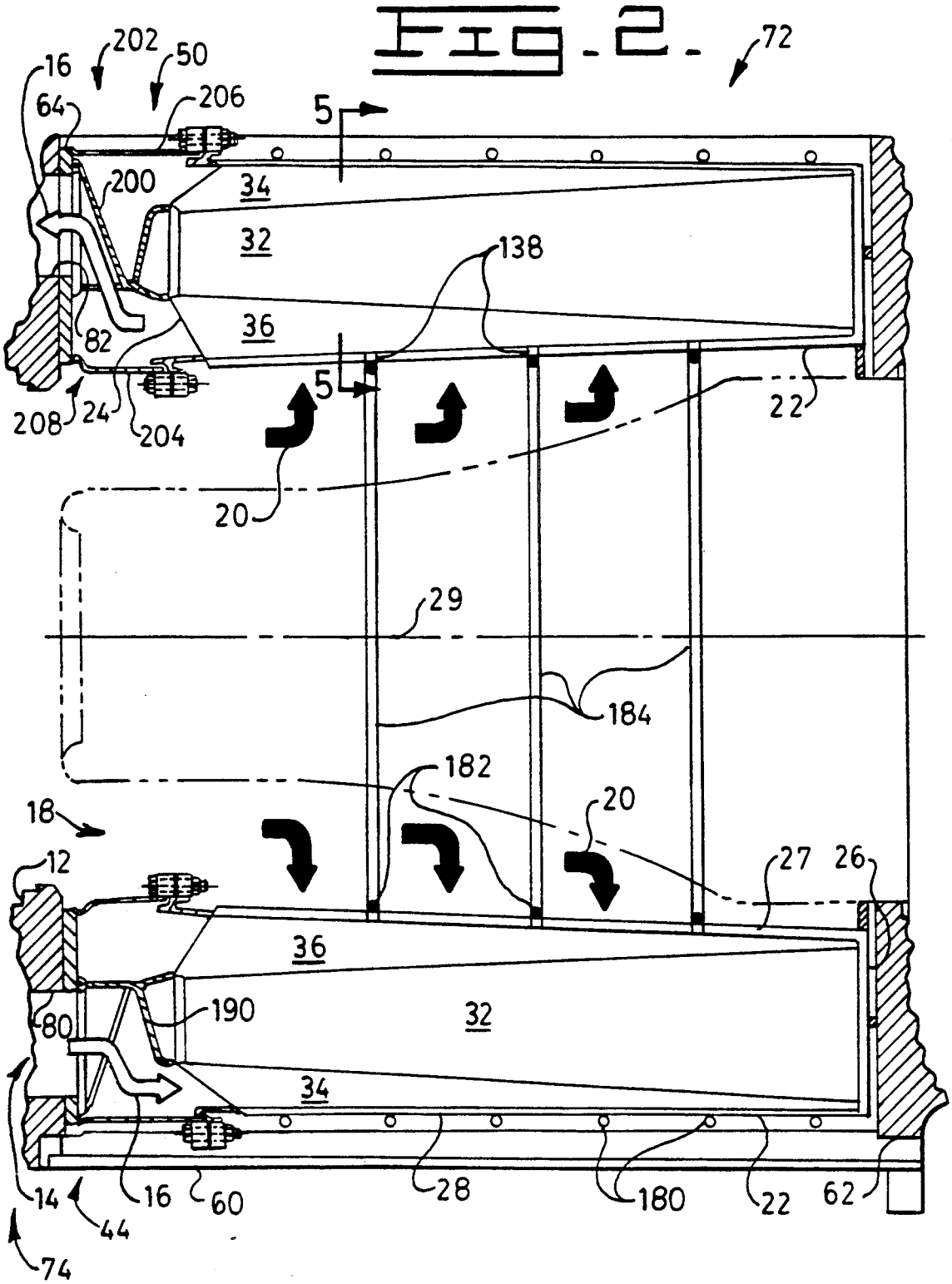
FIG. 2 is a sectional view of a heat exchanger and a portion of the engine.
Figure 5:
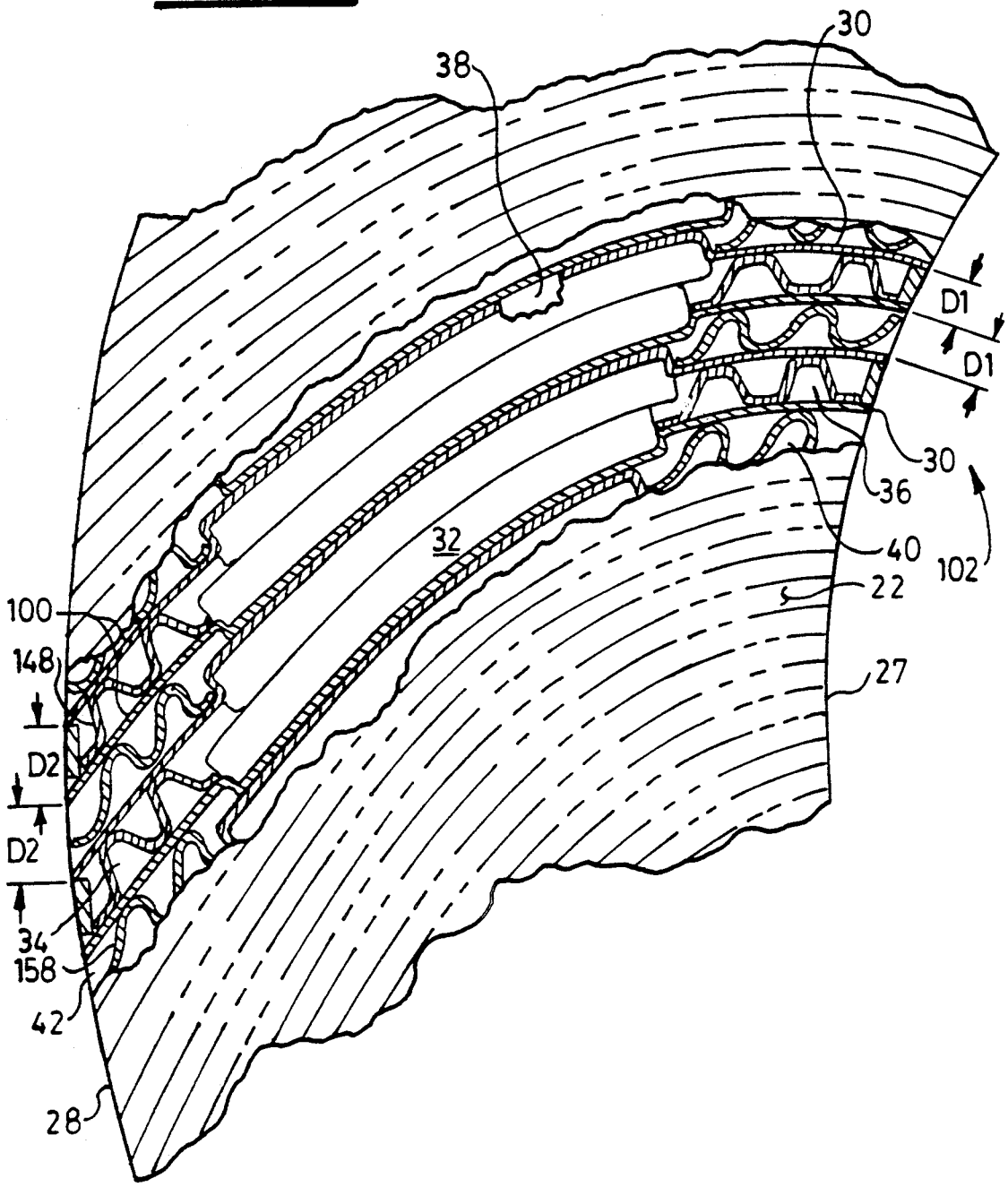
FIG. 5 is an enlarged sectional view through a plurality of cells taken along line 5—5 of FIG. 2.

Referring to the drawings, specifically FIGS. 1, 2 and 5, a heat exchanger or recuperator 10 is attached to an engine 12. The engine 12 in this application is a gas turbine engine including an air intake system 14, only partially shown, having a recipient fluid, designated by the arrow 16, having a preestablished temperature range as a part thereof. The engine 12 further includes an exhaust system 18, only partially shown, having a donor fluid, designated by the arrow 20, having a preestablished temperature range as a part thereof. The temperature range of the recipient fluid 16 is lower than the preestablished temperature of the donor fluid 20. As an alternative, the heat exchanger 10 could be used with any device having the recipient fluid 16 and the donor fluid 20 and in which heat transfer is desirable. The heat exchanger 10 includes a core 22 having a preestablished rate of thermal expansion and being made of many pieces. The core 22 is generally circular in shape and has a pair of ends 24 and 26. The heat exchanger 10 is removably attached to the engine 12. The core 22 further includes an inner portion 27 and an outer portion 28. The heat exchanger 10 could be fixedly attached to the engine 12 without changing the gist of the invention. The core 22 is generally centered about a central axis 29. The core 22 is made up of a plurality of primary surface cells 30. The cells 30 have an involute configuration and includes a first passage or heat recipient or heat recovery passage 32 therein, as best shown in FIG. 5. The passages 32 each have a preestablished transverse cross-sectional area throughout its entire length. The heat exchanger 10 further includes an inlet passage 34 positioned in each of the cells 30 and in fluid communication with corresponding passages 32 for the recipient fluid 16 to pass therethrough prior to entering the passages 32. The heat exchanger 10 further includes an outlet passage 36 positioned in each of the cells 30 and in fluid communication with corresponding passages 32 for the recipient fluid 16 to pass therethrough after passing through the passages 32. The core 22 further includes a plurality of second passages or heat donor passages 38 formed between adjacent cells 30, as best shown in FIG. 5. The heat exchanger 10 further includes a plurality of inlet passages 40 generally positioned inwardly of the heat recipient passages 32 and in fluid communication with individual passages 38 for the donor fluid 20 to pass therethrough prior to entering the passages 38. The heat exchanger 10 further includes a plurality of outlet passages 42 generally positioned outwardly of the heat recipient passages 32 and in fluid communication with individual passages 38 for the donor fluid 20 to pass therethrough after passing through the passages 38. The heat recipient passages 32 are connected to the air intake system 14 and the heat donor passages 38 are connected to the exhaust system 18.

The heat exchanger 10 further includes means 44 for distributing the recipient fluid 16 into the inlet passages 34 and means 50 for collecting the recipient fluid 16 after passing through the outlet passages 36. A housing 56 which is a part of the heat exchanger 10 partially surrounds the core 22. The housing 56 includes a generally cylindrical wrapper plate 60, an end plate 62 and a mounting adapter 64 for attaching to the engine 12. As an alternative, the mounting adapter 64 or the housing 56 could be a part of the engine 12. A plurality of tie bolts 66 interconnect the end plate 62 and the mounting adapter 64 adding further rigidity to the housing 56.

Figure 7:
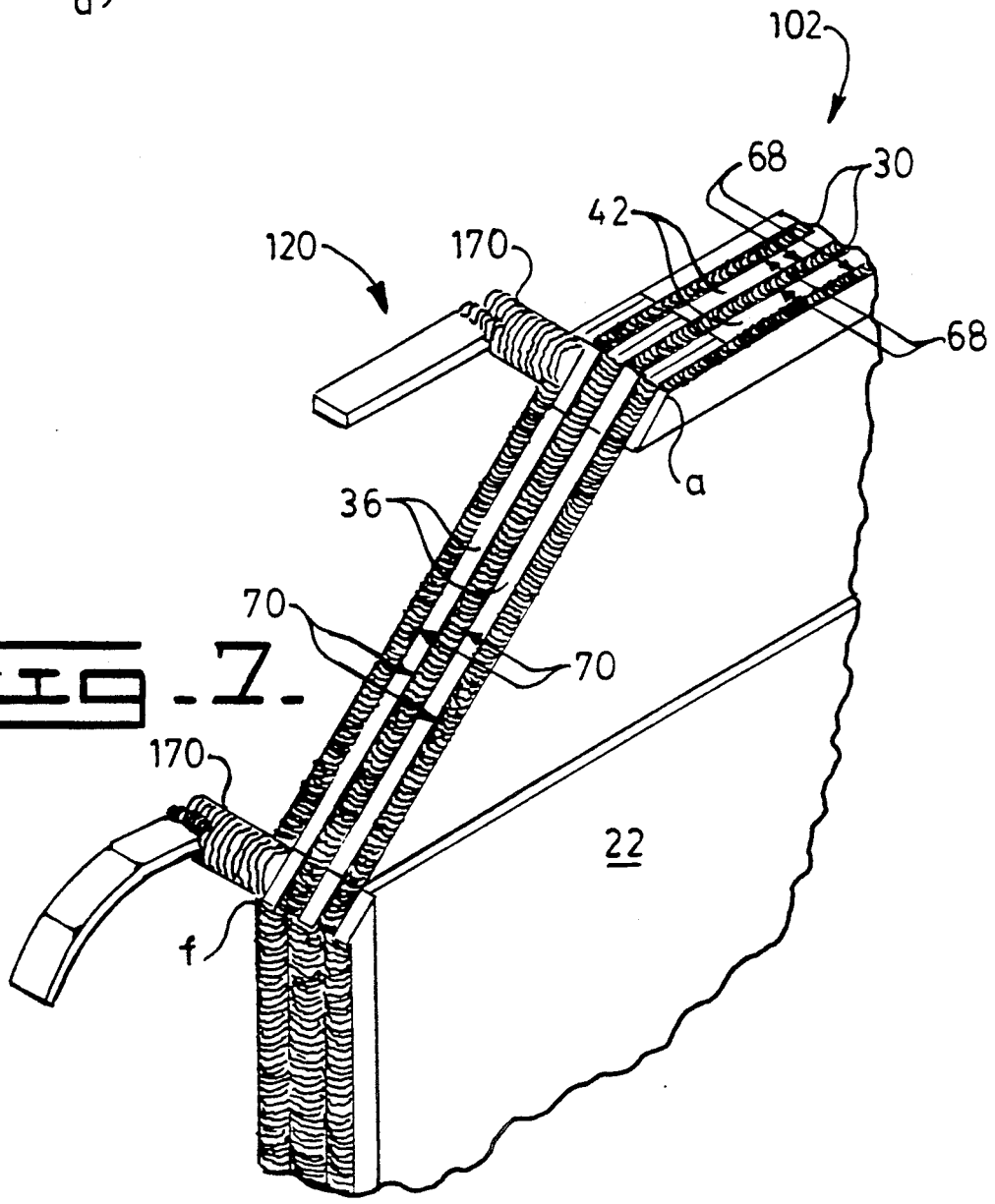
FIG. 7 is a detailed view of a portion of a core showing a portion of the weld thereon.

During operation, the donor fluid 20 passes through the inlet passages 40, heat donor passages 38 and the outlet passages 42 exerting a first working pressure or force, designated by the arrows 68 as best shown in FIG. 7, in the passages 40,38,42 and the recipient fluid 16 passes through the inlet passages 34, heat recipient passages 32 and outlet passages 36 exerting a second working pressure or force, designated by the arrows 70 as best shown in FIG. 7, in the passages 34,32,36. The first and second working pressures 68,70 have different magnitudes of pressure resulting in a combination of forces attempting to separate the cells 30. The heat exchanger 10 further includes a means 72 for resisting the forces attempting to separate the cells 30, or means for expanding and contracting, and a means 74 for sealing. The sealing means 74 insures that the donor fluid 20 passes through the core 22 and insures that the recipient fluid 16 passes through the core 22. The means 72 for expanding and contracting responds to the temperature of only the hotter of the fluids 16,20 and maintains a preestablished force on the heat exchanger 10.

The gas turbine engine 12, which is only partially shown in FIGS. 1 and 2, is of a conventional design and includes a compressor section (not shown) through which clean atmospheric air, or in this application the recipient fluid 16, passes prior to entering the core 22, a power turbine section (not shown) and the exhaust system 18, only partially shown, through which hot exhaust gasses, in this application the donor fluid 20, pass prior to entering the core 22.

The air intake system 14, as partially shown in FIG. 2, of the engine 12 further includes a plurality of inlet ports 80 and a plurality of outlet ports 82, of which only one each is shown, therein through which the recipient fluid 16 passes.

Figure 6:
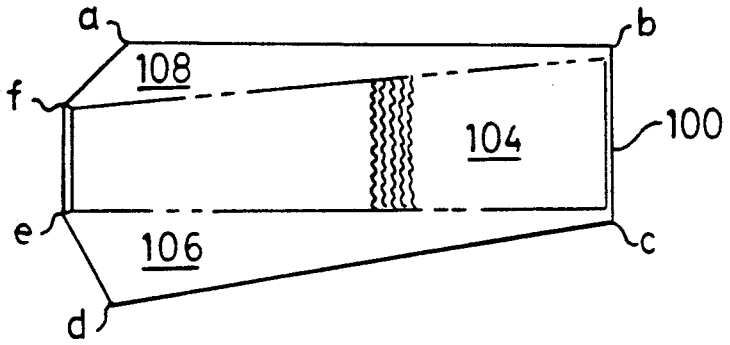
FIG. 6 is a development view of a primary surface pleated sheet showing a plurality of corners on the sheet and corresponding to the plurality of corners of the core.

As best shown in FIGS. 5, 6 and 7, the core 22 includes the plurality of primary surface cells 30 stacked and secured together. The cells 30 include a plurality of individual primary surface pleated sheets 100 and means 148 and 158 for spacing the sheets 100 a preestablished distance apart. Each of the sheets 100 and each of the means for spacing are bent or formed into an involute shaped configuration. Each sheet 100 contains three principal regions. For example, a corrugated or primary surface center portion 104 has a generally trapezoidal shape and a pair of wing portions 106 and 108 have a generally trapezoidal shape. The spacing means includes a plurality of spacer bars having a preestablished thickness positioned at only the inner portion 27 of the core 22. The components are welded together retaining the components in the involute configuration and forming the inlet passage 34, the heat recipient passage 32 and the outlet passage 36. Each of the individual cells 30 is pressure tested to insure quality welds and components prior to being assembled into the core 22.

As best shown in FIG. 6, each of the sheets 100 have a plurality of corners designated by a, b, c, d, e and f. The corners of the sheets 100 have corresponding corners a, b, c, d, e, and f for each of the cells 30. The corresponding corners of each cell 30 are aligned, stacked in contact with another one of the cells 30 and placed in side-by-side contacting relationship to the corresponding wing portions 106 and 108. The stacked cells 30 are secured by means for securing which includes a plurality of circumferential welds 170 along a portion of their edges to secure the cores 30 in the stacked circular array. Each of plurality of corners of the cells 30 have a plurality of corners with the core 22 are welded together. As best shown in FIGS. 6 and 7, a portion of the outer peripheries of successive cells 30 are joined together to form the inlet passages 40, the heat donor passages 38 and the outlet passages 42.

In this specific application, a portion of the circumferential welds 170 are used to weld each of the corners a, b, c, d, e and f. The inner portion 27 of the core 22 has a preestablished circumference and the outer portion 28 of the core 22 has a preestablished circumference. The preestablished circumference of the inner portion 27 of the core 22 is made up of a plurality of linear distances "D1". Each of the distances "D1" is measured from respective sides of each sheet 100 at the inner portion 27 of the core 22. Due to the involute shape of the cells 30, a distance "D2" being greater than the distance "D1" is measured from respective sides of each sheet 100 at the outer portion 28 of the core 22. The combination or addition of the distances "D1" results in the preestablished circumference of the inner portion 27 and the combination or addition of the distance "D2" results in the preestablished circumference of the outer portion 28 of the core 22.

As best shown in FIGS. 1 and 2, the means 72 for resisting the forces attempting to separate the cells 30 and the passage 38 therebetween or the means 72 for expanding and contracting includes a plurality of evenly spaced individual tension rings 180 positioned around the outer portion 28 of the core 22 and a plurality of welds 182 circumferentially connecting aligned spacer bars 138 at the inner portion 27 of the core 22. The plurality of circumferential welds 182 and the spacer bars 138 form a plurality of compressive hoops 184. The hoops 184 are evenly spaced along the inner portion 27 of the core 22 and enable each of the cells 30 to be in force transferring relationship to each other. In this application, three welds 182 or compressive hoops 184 are used, but as an alternative any number of welds or hoops could be used provided the flow through the passage 40 is not overly restricted. Each of the plurality of rings 180 is in contact with the outer portion 28 of the core 22. The tension rings 180 have a rate of thermal expansion which closely matches the rate of thermal expansion of the core 22. The entire resisting means 72 is totally in heat transferring relationship with the donor fluid 20 so that the thermal expansion of the core 22 and the resisting means 72 are acted upon by the same thermal variations resulting in nearly the same rate of expansion and contraction by the resisting means 72 and the core 22. In this instant application, nine tension rings 180 are used. As an alternative (not shown), a single strand of wire or rod could be spirally wound in spaced relationship around the core 22 and resist the forces attempting to separate the passages 32,34,36 and 38,40,42.

Figure 8:
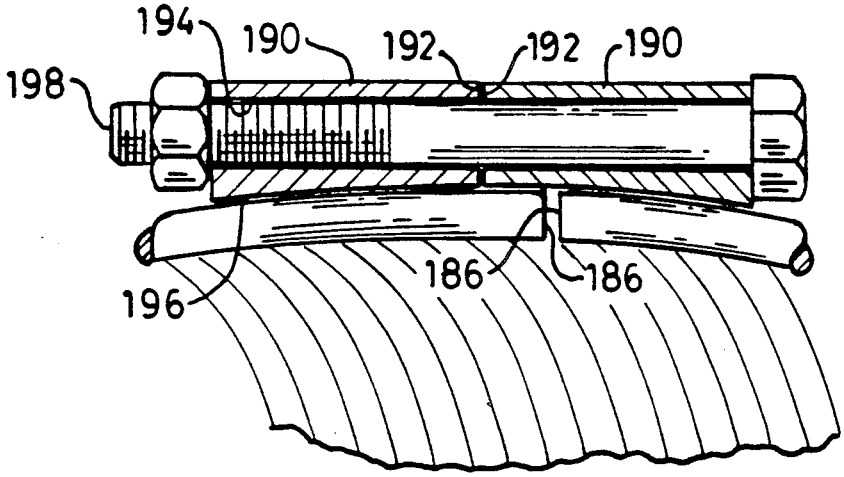
FIG. 8 is a partial section taken through a central axis and showing an alternate and joint of a ring being removably attached in the ring configuration.

As best shown in FIGS. 3 and 4, each of the tension rings 180 has a constant and an equal cross-sectional area along the entire length of the ring. Each ring 180 is circular and has a preestablished constant diameter. As an alternative, each of the tension rings 180 could have different cross-sectional areas, different spacing therebetween and different shaped contours such as a square or hexagonal. In this application, the tension rings 180 are made from a straight rod of Inconel 718 steel and have a diameter or thickness of about six millimeters (6 mm). The rods are rolled and permanently attached in a continuous ring configuration. The rods have a pair of ends 186 which are formed and welded together. A reinforcing rod 188 spans an equal distance from the ends 186 and is fixedly secured to each of the rings 180 by welding. The rings 180 are heated so that they expand in circumference and assemble over the core 22 so that when they cool and shrink, the rings exert a force on the cells 30 and hold them together. As best shown in FIG. 8 as an alternative, the rings 180 could be removably attached in a continuous ring configuration. For example, a pair of mounting flanges 190 would be attached to each end 186. The flanges 190 would have a pair of ends 192 and a through bore 194 exiting at each of the ends 192. A radial groove 196 is provided in each of the flanges 190. The radial groove 196 of one of the flanges 190 is positioned in contacting relationship to one of the rings 180 and is fixedly attached, such as by welding, near one of the ends 186 of each of the rings 180. A preestablished portion of the ring 180 extending beyond the one of the ends 192 of the flange 190. Another of the flanges 190 is positioned in contacting relationship to the same ring 180 and is fixedly attached, such as by welding, near the other end 186 of the ring 180. This end 186 of the above mentioned ring 180 is positioned a preestablished distance inwardly from the end 192 of the flange 190. Thus, as the flanges 190 are secured together by a fastener 198, such as a bolt and nut or a threaded rod and a pair of nuts, the ends 186 of the rings 180 are positioned within the radial groove 196 insuring that the ends 192 are aligned and seated. The fastener 198 is tightened so that the rings 180 apply the proper preestablished force to the core 22. Test measurements have shown that a preestablished force of about 19,000 N in each ring 180 is required to resist the combination of the first and the second working forces 68,70. Further analysis has shown that a force below the 19,000 N will allow the individual cells 30 and the passages 38,40,42 therebetween to separate and cause premature failure or leakage of the core 22. It has further been shown that a force above about 32,000 N will cause the edges of the sheets 100 to crimp and deform partially closing the outlet passages 42 thus reducing the efficiency of the heat exchanger 10.

As best shown in FIG. 2, a portion of the means 74 for sealing includes a manifold 200 which is positioned between the cooler recipient fluid 16 prior to entering the core 22 and the heated recipient fluid 16 after exiting the core 22. An apparatus 202 for surrounding the recipient fluid 16 includes an inner portion 204 and an outer portion 206 which acts as a biasing means 208 for holding one end of the core 22 in contact with the end plate 62 of the housing 56. As best shown in FIG. 2, the means 74 for sealing further has a portion thereof adapted to seal the exhaust system 18 so that the donor fluid 20 passes through the core.

INDUSTRIAL APPLICABILITY

The compressor section of the conventional gas turbine engine 12 compresses atmospheric air or recipient fluid 16 which is then passed through the heat recipient passages 32 of the heat exchanger 10. Exhaust gases or donor fluid 20 from the combustion in the engine 12 pass through the heat donor passages 38 of the heat exchanger 10 and thermally heats the recipient fluid 16 in the heat exchanger 10. The recipient fluid is then mixed with fuel, combusted and exhausted as the donor fluid 20. Thus, during operation of the engine 12, a continuous cycle occurs.

In use, the donor fluid 20 which is generally about 650° C. and slightly above ambient pressure passes through the donor passage 38 and heats the individual primary surface pleated sheets 100. At the same time, pressurized recipient fluid 16 from the compressor is generally about 440° C. and about 1500 kPa passes through the inlet passage 34, recipient passage 32 and outlet passage 36 wherein the recipient fluid 16 is heated by the individual primary surface pleated sheets 100. The second working pressure or force 70 in the donor passage 38 and the first working pressure or force 68 in the recipient passage 32 attempt to separate individual cells 30 and passages 38,40,42 therebetween.

During cyclic operation, such as for vehicular or marine applications, of the engine 12, starting, idling, acceleration and stopping, the heat exchanger 10 will vary in size about the outer portion 28 and inner portion 27 of the core 22 with the increase and decrease in heat passing through the heat exchanger 10. The tension rings 180 and the compressive hoops 184 also increase and decrease in size nearly equal to the change in size of the heat exchanger 10 since the thermal expansion characteristics are nearly equal. The first and second pressures or forces 68,70 attempt to straighten the involute configuration of each cell 30. Thus, the tension rings 180 and the compressive hoops 184 resist the forces attempting to separate the cells 30 and the passages 38,40,42 therebetween. The rings 180 and the hoops 184 prevent the individual cells 30 and the passages 38,40,42 therebetween from ballooning and separating. At initial assembly, the rings 180 are heated to a preestablished temperature of about 300° so that they increase in size and can be slipped over the outer portion 28 of the core 22. Nine of the rings 180 are evenly spaced along the outer portion 28 of the core 22 and allowed to cool and decrease in size. The rings 180 are presized to exert a force of about 1500 N on the core 22 in the atmospheric or unheated state of the rings 180 and the core 22. During the cyclic heating and cooling of the core 22 and the tension rings 180, the outer portion 28 of the core and the rings 180 seat and take on a permanent set or configuration.

The size and the material of the rings 180 are specifically selected to have a thermal growth characteristic which closely match that of the core 22 so that the force applied to the core remains within preselected limits during the heating and cooling cycles of the heat exchanger 10. Since, the coefficient of thermal expansion of the Inconel 718 rings 180 is slightly less than that of the Alloy 230 core, the force on the outer portion 28 of the core will increase slightly during the heating of the core 22. However, the force will remain well below the compression strength of the Alloy 230 sheets 100 and the increase in the force has no deleterious effect on the core. Inconel 718 steel was selected for the material because it has excellent high temperature strength and complete freedom from creep in the design temperature range.

The compressive hoops 184 resist the expansion of the core 22 toward the inside. For example, the inner portion 27 of the core 22 attempts to expand toward the inside, but since the cells 30 are in contacting relationship at the inner portion 27, movement toward the inside is nearly totally prevented. The force is absorbed in each of the cells 30. Thus, the diameter at the inner portion 27 of the core 22 remains nearly constant. The hoops 184, the plurality of spacers 138 and each of the cells 30 being in contacting relationship to each other resist the expansion forces at the inner portion 27 of the core 22 and cause the cells to increase in length toward the outer portion 28.

In view of the foregoing, it is readily apparent that the structure of the present invention provides an improved thermally balanced ring restraint system 72 for the circular heat exchanger 10. The system 72 is totally in heat transferring relationship with the donor fluid 20. The system is economical to use and manufacture. The system eliminates a complex groove configuration in the core 22 and the welding of the system at the outer portion 28 of the core 22. And, the system provides a thermal response nearly equal to that of the core 22 itself. Thus, the thermally balanced rings 180 and the compressive hoops 184 provide a system that drastically reduces transient thermal stresses over known external restraint systems used with circular heat exchangers.

Other aspects, objects and advantages will become apparent from a study of the specification, drawings and appended claims.

I claim:

1. A heat exchanger including a core having a plurality of heat recipient passages and a plurality of heat donor passages therein, comprising:

said core including a plurality of cells each defining one of the passages therein, the cells being secured together forming a generally circular core, adjacent cells forming the other of the passages and the core further including an inner portion and an outer portion;

each of said heat donor passages having a donor fluid therein during operation and each of said heat recipient passages having a recipient fluid therein during operation, said donor fluid exerting a first working pressure and force and said recipient fluid exerting a second working pressure and force in the passages when in operation, said working pressures and forces attempting to separate the passages; and means for resisting the forces attempting to separate the passages, at least a portion of said means being positioned externally around the outer portion of the core and the entire means being totally in heat transferring relationship with the donor fluid.

2. The heat exchanger of claim 1 wherein said means for resisting includes one tension ring being positioned around the outer portion of the core and in contact therewith.

3. The heat exchanger of claim 2 wherein said core has a preestablished rate of thermal expansion and said tension rings each have a rate of thermal expansion which closely matches the rate of thermal expansion of the core.

4. The heat exchanger of claim 3 wherein each of said tension rings is permanently attached in a continuous ring configuration.

5. The heat exchanger of claim 3 wherein each of said tension rings is removably attached in a continuous ring configuration.

6. The heat exchanger of claim 1 wherein said means for resisting includes a plurality of evenly spaced individual tension rings positioned around the outer portion of the core and in contact therewith.

7. The heat exchanger of claim 6 wherein said core has a preestablished rate of expansion and said individual tension rings have a rate of thermal expansion which closely matches the rate of thermal expansion of the core.

8. The heat exchanger of claim 6 wherein each of said individual tension rings has a constant cross-sectional area along the entire length of the ring and the cross-sectional area of each individual tension ring is equal to each other.

9. The heat exchanger of claim 8 wherein said cross-sectional area is circular and has a predetermined thickness.

10. The heat exchanger of claim 9 wherein said individual tension rings are made from Inconel 718 steel.

11. The heat exchanger of claim 10 wherein said predetermined thickness of each ring is about 6 millimeters.

12. The heat exchanger of claim 1 wherein said means for resisting includes a compressive hoop positioned at the inner portion of the core.

13. The heat exchanger of claim 12 wherein said compressive hoop is formed by each of the cells being in contacting relationship to each other at the inner portion of the core.

14. The heat exchanger of claim 12 wherein said compressive hoop further includes one weld radially connecting each of the cells at the inner portion of the core.

15. A gas turbine engine including an exhaust system having a donor fluid therein, an air intake system having a recipient fluid therein, a heat exchanger including a core having a heat recipient passage and a heat donor passage therein, a housing surrounding the core, said exhaust system being connected to the heat donor passage and said air intake system being connected to the heat recovery passage, comprising:

said core including a plurality of stacked cells each defining one of the passages therein, the cells being secured together, forming a generally circular core and being centered about an axis, adjacent cells forming the other of the passages therebetween and said core further including an outer portion and an inner portion;

said donor fluid in each of said heat donor passages during the operation of the engine exerting a first working pressure and force within the passage resulting in a force attempting to separate the passages;

said recipient fluid in each of said heat recipient passages during operation of the engine exerting a second working pressure and force within the passages resulting in a force attempting to separate the passages; and means for resisting the forces attempting to separate the passages, at least a portion of said means being positioned externally around the outer portion of the core and the entire means being totally in heat transferring relationship with the donor fluid.

16. The heat exchanger of claim 15 wherein said means for resisting includes tension ring being positioned around the outer portion of the core and in contact therewith.

17. The heat exchanger of claim 16 wherein said core has a preestablished rate of expansion and the tension rings each have a rate of thermal expansion which closely matches the rate of thermal expansion of the core.

18. The heat exchanger of claim 17 wherein each of said tension rings is permanently attached in a continuous ring configuration.

19. The heat exchanger of claim 17 wherein each of said tension rings is removably attached in a continuous ring configuration.

20. The heat exchanger of claim 15 wherein said means for resisting includes a plurality of evenly spaced individual tension rings positioned around the outer portion of the core and in contact therewith.

21. The heat exchanger of claim 20 wherein said core has a preestablished rate of expansion and the individual tension rings each have a rate of thermal expansion which closely matches the rate of thermal expansion of the core.

22. The heat exchanger of claim 21 wherein each of said individual tension rings has a constant cross-sectional area along the entire length of the ring and the cross-sectional area of each individual tension ring is equal to each other.

23. The heat exchanger of claim 22 wherein said cross-sectional area is circular and has a predetermined thickness.

24. The heat exchanger of claim 21 wherein said individual tension rings are made from Inconel 718 steel.

25. The heat exchanger of claim 23 wherein said predetermined thickness of each ring is about 6 millimeters.

26. The heat exchanger of claim 15 wherein said means for resisting includes a compressive hoop positioned at the inner portion of the core.

27. The heat exchanger of claim 26 wherein said compressive hoop is formed by the cells being in force transferring relationship to each other at the inner portion of the core.

28. The heat exchanger of claim 26 wherein said compressive hoop further includes one weld radially connecting each of the cells at the inner portion of the core.

29. A heat exchanger, comprising:

a core being made of many pieces and having a plurality of first and second passages adapted to receive fluids of different temperatures, said core further having a generally circular configuration and including an outer portion, said fluids exerting different pressures on said heat exchanger pieces; and means for expanding and contracting in response to the temperature of only one of the fluids, and maintaining a preestablished force on said heat exchanger pieces, and means for expanding and contraction including at least a portion of said means being positioned externally around the outer portion of the core and the entire means being totally in heat transferring relationship with one of the fluids.

30. The heat exchanger of claim 29 wherein said preestablished force has a range of between about 1500 N and 19,000 N.

31. The heat exchanger of claim 29 wherein said core includes an inner portion.

32. The heat exchanger of claim 31 wherein said means for expanding and contracting includes one tension ring being positioned around the outer portion of the core and in contact therewith.

33. The heat exchanger of claim 32 wherein said core has a preestablished rate of thermal expansion and the one tension ring has a rate of thermal expansion which closely matches the rate of thermal expansion of the core.

34. The heat exchanger of claim 32 wherein each of said tension rings is permanently attached in a continuous ring configuration.

35. The heat exchanger of claim 32 wherein each of said tension rings is removably attached in a continuous ring configuration.

36. The heat exchanger of claim 29 wherein said means for expanding and contracting includes a plurality of evenly spaced individual tension rings positioned around the outer portion of the core and in contact therewith.

37. The heat exchanger of claim 36 wherein said core has a preestablished rate of expansion and said individual tension rings have a rate of thermal expansion which closely matches the rate of thermal expansion of the core.

38. The heat exchanger of claim 37 wherein each of said individual tension rings has a constant cross-sectional area along the entire length of the ring, and the cross-sectional area of each individual tension ring is equal to each other.

39. The heat exchanger of claim 38 wherein said cross-sectional area is circular and has a predetermined thickness.

40. The heat exchanger of claim 39 wherein said individual tension rings are made from Inconel 718 steel.

41. The heat exchanger of claim 39 wherein said predetermined thickness of each ring is about 6 millimeters.

* * * * *